US008160874B2

(12) United States Patent
Kawashima et al.

(10) Patent No.: US 8,160,874 B2
(45) Date of Patent: Apr. 17, 2012

(54) SPEECH FRAME LOSS COMPENSATION USING NON-CYCLIC-PULSE-SUPPRESSED VERSION OF PREVIOUS FRAME EXCITATION AS SYNTHESIS FILTER SOURCE

(75) Inventors: Takuya Kawashima, Ishikawa (JP); Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 957 days.

(21) Appl. No.: 12/159,312

(22) PCT Filed: Dec. 26, 2006

(86) PCT No.: PCT/JP2006/325966

§ 371 (c)(1),
(2), (4) Date: Jun. 26, 2008

(87) PCT Pub. No.: WO2007/077841

PCT Pub. Date: Jul. 12, 2007

(65) Prior Publication Data

US 2009/0234653 A1 Sep. 17, 2009

(30) Foreign Application Priority Data

Dec. 27, 2005 (JP) ..... 2005-375401

(51) Int. Cl.
*G10L 19/12* (2006.01)
*G10L 19/00* (2006.01)

(52) U.S. Cl. ..... 704/228; 704/262; 704/219

(58) Field of Classification Search ..... None
See application file for complete search history.

(56) References Cited

U.S. PATENT DOCUMENTS 5,550,543 A * 8/1996 Chen et al. ..... 341/94
5,572,622 A * 11/1996 Wigren et al. ..... 704/228
5,596,678 A * 1/1997 Wigren et al. ..... 704/228
5,598,506 A * 1/1997 Wigren et al. ..... 704/233

(Continued)

FOREIGN PATENT DOCUMENTS

JP 4-264597 9/1992

(Continued)

OTHER PUBLICATIONS

English language Abstract of JP 10-91194, Oct. 4, 1998.

(Continued)

*Primary Examiner* — Talivaldis Ivars Smits
(74) *Attorney, Agent, or Firm* — Greenblum & Bernstein, P.L.C.

(57) ABSTRACT

An audio decoding device performs frame loss compensation capable of obtaining a decoded audio which is natural for ears with little noise. The audio decoding device includes a non-cyclic pulse waveform detection unit for detecting a non-cyclic pulse waveform section in a n−1-th frame, which is repeatedly used with a pitch cycle in the n-th frame upon compensation of loss of the n-th frame. The audio coding device also includes a non-cyclic pulse waveform suppression unit for suppressing a non-cyclic pulse waveform by replacing an audio source signal existing in the non-cyclic pulse waveform section in the n−1-th frame by a noise signal. The audio coding device further includes a synthesis filter for using a linear prediction coefficient decoded by an LPC decoding unit to perform synthesis by a synthesis filter by using the audio source signal of the n−1-th frame from the non-cyclic pulse waveform suppression unit as a drive audio source, thereby obtaining the decoded audio signal of the n-th frame.

5 Claims, 7 Drawing Sheets

U.S. PATENT DOCUMENTS

| | | | | |
|---|---|---|---|---|
| 5,615,298 | A * | 3/1997 | Chen | 704/228 |
| 5,732,389 | A * | 3/1998 | Kroon et al. | 704/223 |
| 5,828,811 | A | 10/1998 | Taniguchi et al. | |
| 5,884,010 | A * | 3/1999 | Chen et al. | 704/228 |
| 6,233,550 | B1 * | 5/2001 | Gersho et al. | 704/208 |
| 6,377,915 | B1 | 4/2002 | Sasaki | |
| 6,678,267 | B1 * | 1/2004 | Anandakumar et al. | 370/356 |
| 6,775,649 | B1 * | 8/2004 | DeMartin | 704/201 |
| 6,810,377 | B1 * | 10/2004 | Ho et al. | 704/208 |
| 6,826,527 | B1 * | 11/2004 | Unno | 704/223 |
| 6,889,185 | B1 | 5/2005 | McCree | |
| 6,968,309 | B1 * | 11/2005 | Makinen et al. | 704/219 |
| 7,302,385 | B2 * | 11/2007 | Sung et al. | 704/219 |
| 7,308,406 | B2 * | 12/2007 | Chen | 704/262 |
| 7,324,937 | B2 * | 1/2008 | Thyssen et al. | 704/219 |
| 7,379,865 | B2 * | 5/2008 | Kang et al. | 704/219 |
| 7,596,489 | B2 * | 9/2009 | Kovesi et al. | 704/219 |
| 7,711,563 | B2 * | 5/2010 | Chen | 704/262 |
| 2003/0177011 | A1 | 9/2003 | Yasuda et al. | |
| 2006/0080109 | A1 | 4/2006 | Kakuno et al. | |
| 2007/0299669 | A1 | 12/2007 | Ehara | |
| 2008/0069245 | A1 | 3/2008 | Kadono et al. | |
| 2008/0130761 | A1 | 6/2008 | Kadono et al. | |

FOREIGN PATENT DOCUMENTS

| | | |
|---|---|---|
| JP | 10-222196 | 8/1998 |
| JP | 10-91194 | 10/1998 |
| JP | 11-143498 | 5/1999 |
| JP | 2000-267700 | 9/2000 |
| JP | 2001-51698 | 2/2001 |
| JP | 2002/366195 | 12/2002 |
| JP | 2004-20676 | 1/2004 |
| WO | 2002/071389 | 9/2002 |

OTHER PUBLICATIONS

Japan Office Action for the corresponding Japanese Patent Application, mailed Feb. 21, 2012.

* cited by examiner

SPEECH FRAME LOSS COMPENSATION USING NON-CYCLIC-PULSE-SUPPRESSED VERSION OF PREVIOUS FRAME EXCITATION AS SYNTHESIS FILTER SOURCE

TECHNICAL FIELD

The present invention relates to a speech decoding apparatus and a speech decoding method.

BACKGROUND ART

Best-effort type speech communication represented by VoIP (Voice over IP) is commonly used in recent years. Transmission bands are generally not guaranteed in such speech communication, and therefore some frames may be lost during transmission, speech decoding apparatuses may not be able to receive part of coded data, and such data may remain missing. When, for example, traffic in a communication path is saturated due to congestion or the like, some frames may be discarded, and coded data may be lost during transmission. Even when such a frame loss occurs, the speech decoding apparatus must compensate for (conceal) the lacking voice part produced by the frame loss with speech that brings less annoying perceptually.

There is such a conventional technique for frame loss concealment that applies different loss concealment processing to voiced frames and unvoiced frames (e.g., see Patent Document 1). When a lost frame is a voiced frame, this conventional technique performs such frame loss concealment processing that repeatedly uses parameters of the frame immediately preceding the lost frame. On the other hand, when the lost frame is an unvoiced frame, the conventional technique performs such frame loss concealment processing that adds a noise signal to an excitation signal from a noise codebook, or randomly selects an excitation signal from the noise codebook, thereby preventing generation of decoded speech that brings perceptually strong annoying effects which are caused by consecutive use of an excitation signal having the same waveform.

Patent Document 1: Japanese Patent Application Laid-Open No. HEI10-91194

DISCLOSURE OF INVENTION

Problems to be Solved by the Invention

However, in frame loss concealment according to the above-described conventional technique for loss of voiced frames, as shown in FIG. 1, when a frame ((n−1)-th frame) immediately preceding a lost frame (n-th frame) has a region including such plosive consonants (e.g., 'p', 'k', 't') whose onset part has very large amplitude, by repeatedly using such a region for frame loss concealment, a decoded speech signal that brings perceptually strong annoying effects, such as loud beep sounds, is produced in the frame (n-th frame) subjected to frame loss concealment. In addition to plosive consonants, if a frame immediately preceding a lost frame has a region including speech having sporadic and locally large amplitude, such as background noise, the decoded speech signal that brings perceptually strong annoying effects is produced in the same way.

Furthermore, in frame loss concealment according to the above-described conventional technique for loss of an unvoiced frame, the entire lost frame (n-th frame) is concealed by a noise signal having a characteristic different from that of the speech of the immediately preceding frame ((n−1)-th frame) as shown in FIG. 2, and therefore the articulation of the decoded speech degrades, and decoded speech with perceptually noticeable noise in the entire frame is produced.

Thus, the frame loss concealment according to the above-described conventional technique has a problem that decoded speech deteriorates perceptually.

It is therefore an object of the present invention to provide a speech decoding apparatus and a speech decoding method that make it possible to perform frame loss concealment capable of obtaining perceptually natural decoded speech with no noticeable noise.

Means for Solving the Problem

The speech decoding apparatus of the present invention adopts a configuration including: a detection section that detects a non-periodic pulse waveform region in a first frame; a suppression section that suppresses a non-periodic pulse waveform in the non-periodic pulse waveform region; and a synthesis section that performs synthesis by a synthesis filter using the first frame where the non-periodic pulse waveform is suppressed as an excitation and obtains decoded speech of a second frame after the first frame.

ADVANTAGEOUS EFFECT OF THE INVENTION

According to the present invention, it is possible to perform frame loss concealment capable of obtaining perceptually natural decoded speech without noticeable noise.

BEST MODE FOR CARRYING OUT THE INVENTION

Embodiments of the present invention will be explained in detail below with reference to the accompanying drawings.

Embodiment 1

Figure 1:
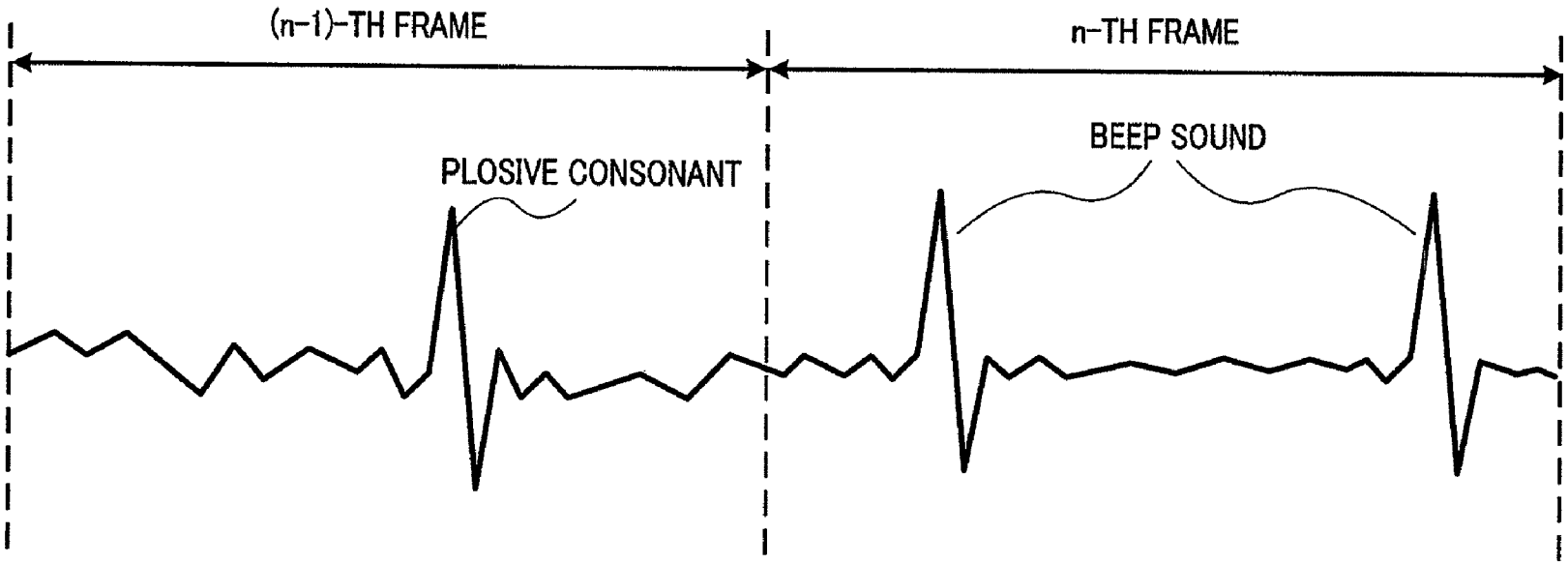
FIG.1 PRIOR ART
FIG. 1 illustrates the operation of a conventional speech decoding apparatus.
Figure 2:
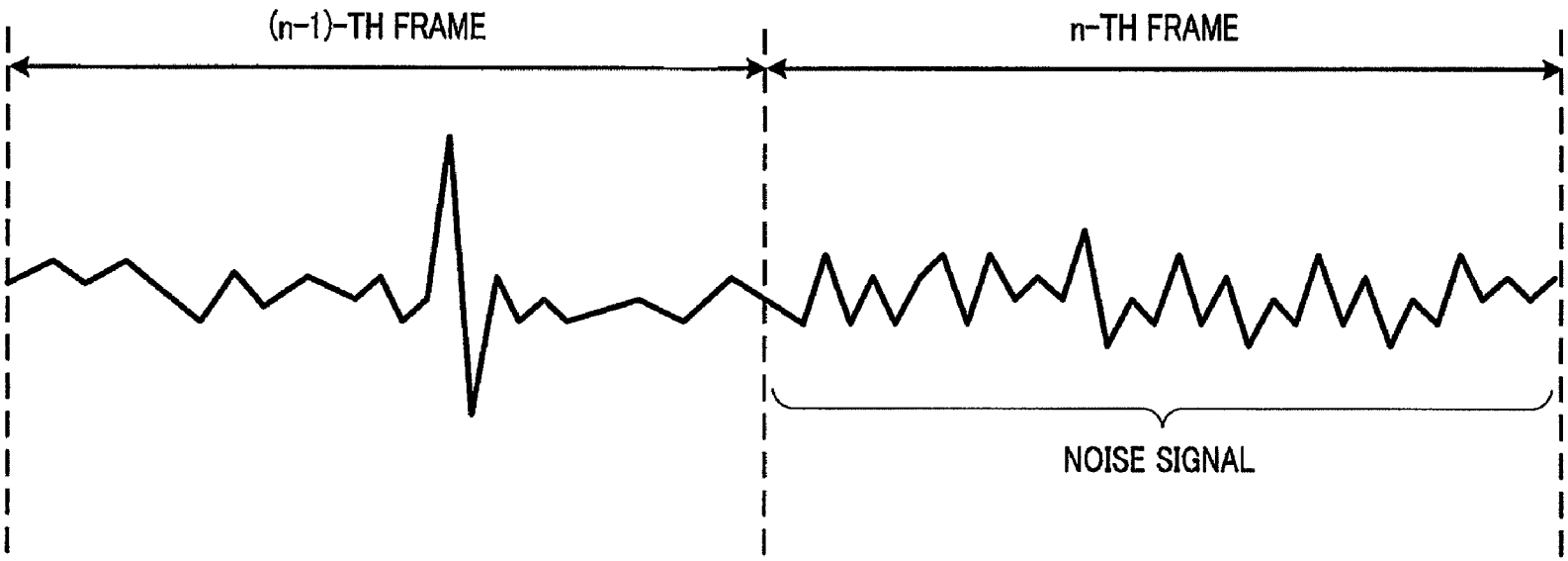
FIG.2 PRIOR ART
FIG. 2 illustrates the operation of the conventional speech decoding apparatus.
Figure 3:
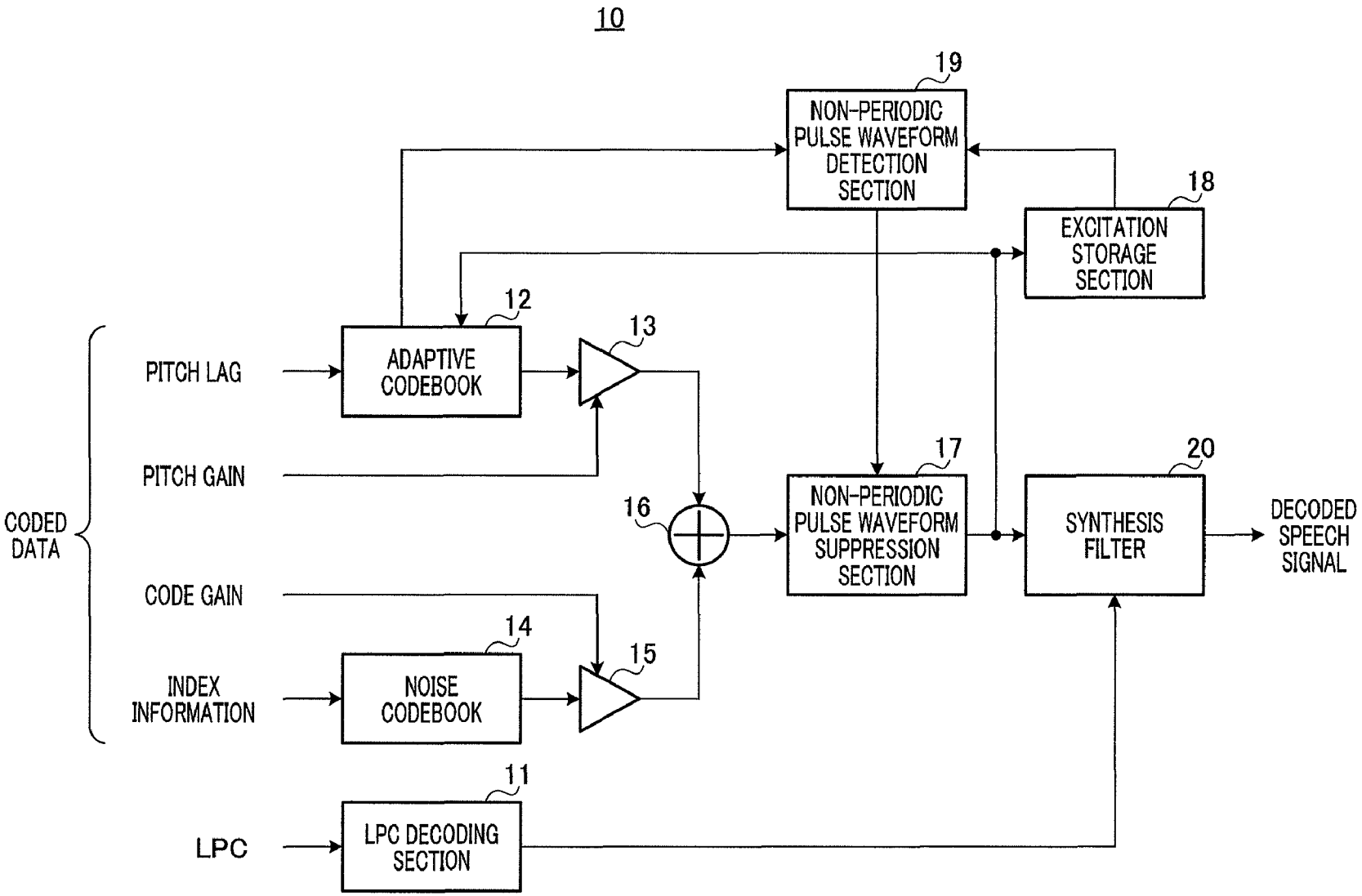
FIG. 3 is a block diagram showing the configuration of a speech decoding apparatus according to Embodiment 1.

FIG. 3 is a block diagram showing the configuration of speech decoding apparatus 10 according to Embodiment 1 of the present invention. A case will be described below as an example where an n-th frame is lost during transmission and the loss of the n-th frame is compensated for (concealed) using the (n−1)-th frame which immediately precedes the n-th frame. That is, a case will be described where an excitation signal of the (n−1)-th frame is repeatedly used in a pitch period when the lost n-th frame is decoded.

When the (n−1)-th frame has a region (hereinafter "non-periodic pulse waveform region") including a waveform (hereinafter "non-periodic pulse waveform") which is not periodically repeated, that is, non-periodic, and has locally large amplitude, speech decoding apparatus 10 according to the present embodiment is designed to substitute a noise signal for only an excitation signal of the non-periodic pulse waveform region in the (n−1)-th frame and suppress the non-periodic pulse waveform.

In FIG. 3, LPC decoding section 11 decodes coded data of a linear predictive coefficient (LPC) and outputs the decoded linear predictive coefficient.

Adaptive codebook 12 stores a past excitation signal, outputs a past excitation signal selected based on a pitch lag to pitch gain multiplication section 13 and outputs pitch information to non-periodic pulse waveform detection section 19. The past excitation signal stored in adaptive codebook 12 is an excitation signal subjected to processing at non-periodic pulse waveform suppression section 17. Adaptive codebook 12 may also store an excitation signal before being subjected to processing at non-periodic pulse waveform suppression section 17.

Noise codebook 14 generates and outputs signals (noise signals) for expressing noise-like signal components that cannot be expressed by adaptive codebook 12. Noise signals algebraically expressing pulse positions and amplitudes are often used as noise signals in noise codebook 14. Noise codebook 14 generates noise signals by determining pulse positions and amplitudes based on index information of the pulse positions and amplitudes.

Pitch gain multiplication section 13 multiplies the excitation signal inputted from adaptive codebook 12 by a pitch gain and outputs the multiplication result.

Code gain multiplication section 15 multiplies the noise signal inputted from noise codebook 14 by a code gain and outputs the multiplication result.

Addition section 16 outputs an excitation signal obtained by adding the excitation signal multiplied by the pitch gain to the noise signal multiplied by the code gain.

Non-periodic pulse waveform suppression section 17 suppresses the non-periodic pulse waveform by substituting a noise signal for the excitation signal in the non-periodic pulse waveform region in the (n−1)-th frame. Details of non-periodic pulse waveform suppression section 17 will be described later.

Excitation storage section 18 stores an excitation signal subjected to the processing at non-periodic pulse waveform suppression section 17.

The non-periodic pulse waveform becomes the cause for generating decoded speech that brings perceptually strong uncomfortable feeling, such as beep sound, and therefore non-periodic pulse waveform detection section 19 detects the non-periodic pulse waveform region in the (n−1)-th frame which will be used repeatedly in a pitch period in the n-th frame when loss of the n-th frame is concealed, and outputs region information that designates the region. This detection is performed using an excitation signal stored in excitation storage section 18 and the pitch information outputted from adaptive codebook 12. Details of non-periodic pulse waveform detection section 19 will be described later.

Synthesis filter 20 performs synthesis through a synthesis filter using the linear predictive coefficient decoded by LPC decoding section 11 and using the excitation signal in the (n−1)-th frame from non-periodic pulse waveform suppression section 17 as an excitation. The signal obtained by this synthesis becomes a decoded speech signal in the n-th frame at speech decoding apparatus 10. The signal obtained through this synthesis may also be subjected to post-filtering processing. In this case, the signal after post-filtering processing becomes the output of speech decoding apparatus 10.

Figure 4:
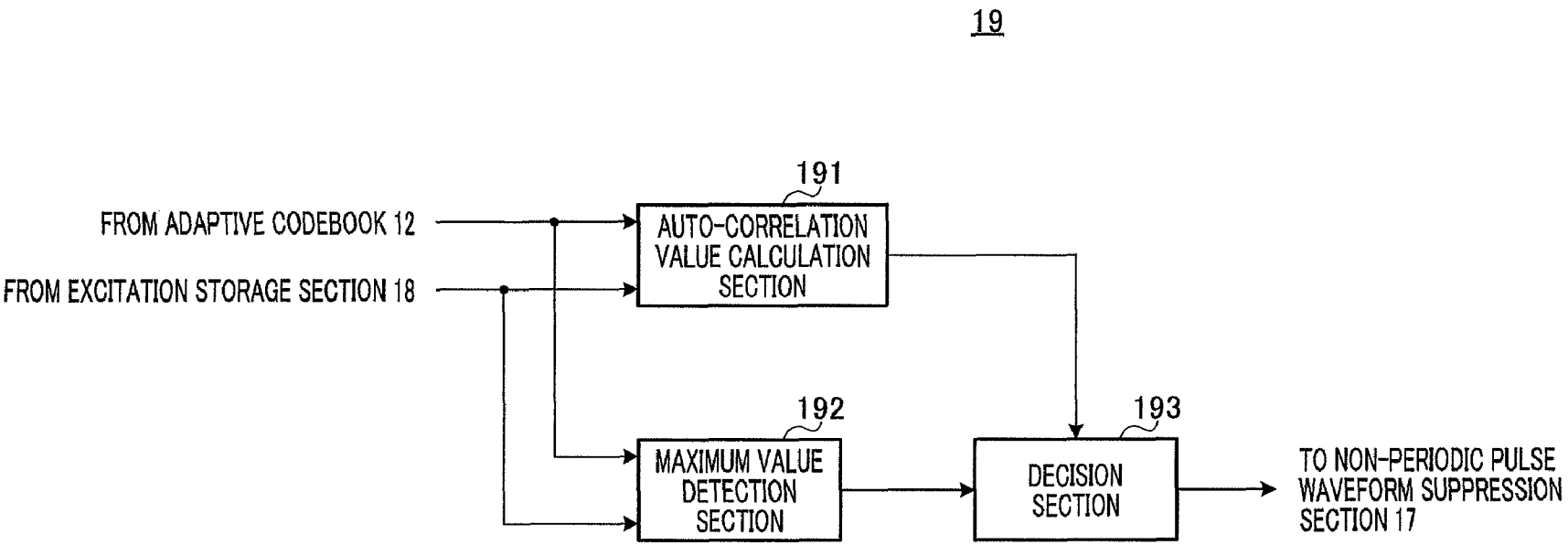
FIG. 4 is a block diagram showing the configuration of a non-periodic pulse waveform detection section according to Embodiment 1.

Next, details of non-periodic pulse waveform detection section 19 will be explained. FIG. 4 is a block diagram showing the configuration of non-periodic pulse waveform detection section 19.

Here, when an auto-correlation value of the excitation signal in the (n−1)-th frame is large, periodicity thereof is considered to be high and the lost n-th frame is also considered in the same way to be a region including an excitation signal with high periodicity (e.g., vowel region), and therefore better decoded speech may be obtained by using the excitation signal in the (n−1)-th frame repeatedly in a pitch period for frame loss concealment of the n-th frame. On the other hand, when the auto-correlation value of the excitation signal in the (n−1)-th frame is small, the periodicity thereof may be low and the (n−1)-th frame may include the non-periodic pulse waveform region. Therefore, if the excitation signal in the (n−1)-th frame is repeatedly used in a pitch period for frame loss concealment in the n-th frame, decoded speech that brings perceptually strong uncomfortable feeling, such as beep sound, is produced.

Therefore, non-periodic pulse waveform detection section 19 detects the non-periodic pulse waveform region as follows.

Auto-correlation value calculation section 191 calculates an auto-correlation value in a pitch period of the excitation signal in the (n−1)-th frame from the excitation signal in the (n−1)-th frame from excitation storage section 18 and the pitch information from adaptive codebook 12 as a value showing the periodicity level of the excitation signal in the (n−1)-th frame. That is, a greater auto-correlation value shows higher periodicity and a smaller auto-correlation value shows lower periodicity.

Auto-correlation value calculation section 191 calculates an auto-correlation value according to equations 1 to 3. In equations 1 to 3, exc[ ] is an excitation signal in the (n−1)-th frame, PITMAX is a maximum value of a pitch period that speech decoding apparatus 10 can take, T0 is a pitch period length (pitch lag), exccorr is an auto-correlation value candidate, excpow is pitch period power, exccorrmax is a maximum value (maximum auto-correlation value) among auto-correlation value candidates, and constant $\tau$ is a search range of the maximum auto-correlation value. Auto-correlation value calculation section 191 outputs the maximum auto-correlation value expressed by equation 3 to decision section 193.

(Equation 1)

$$exccorr[j] = \sum_{i=0}^{T0-1} exc[PITMAX-1-j-i] * exc[PITMAX-1-i] \quad (T0-\tau \le j < T0+\tau) \tag{1}$$

(Equation 2)

$$excpow = \sum_{i=0}^{T0-1} exc[PITMAX-1-i] * exc[PITMAX-1-i] \tag{2}$$

(Equation 3)

$$exccorr\max = \max_{j=T0-\tau}^{T0+\tau-1} (exccorr[j]/excpow) \tag{3}$$

On the other hand, maximum value detection section 192 detects a first maximum value of the excitation amplitude in the pitch period from the excitation signal in the (n−1)-th frame from excitation storage section 18 and the pitch information from adaptive codebook 12 according to equations 4 and 5. excmax1 shown in equation 4 is the first maximum value of the excitation amplitude. Furthermore, excmax1pos shown in equation 5 is the value of j for the first maximum value and shows the position in the time domain of the first maximum value in the (n−1)-th frame.

(Equation 4)

$$excmax1 = \max_{j=0}^{T0-1}(|exc[PITMAX-1-j]|) \quad [4]$$

(Equation 5)

$$excmax1\,pos = j(j \text{ when } excmax1) \quad [5]$$

Furthermore, maximum value detection section 192 detects a second maximum value of the excitation amplitude which is the second largest in the pitch period after the first maximum value. As in the case of the first maximum value, maximum value detection section 192 can detect the second maximum value (excmax2) of the excitation amplitude and the position in the time domain (excmax2pos) of the second maximum value in the (n−1)-th frame by performing detection according to equations 4 and 5 after excluding the first maximum value from the detection targets. When the second maximum value is detected, it is preferable to also exclude samples around the first maximum value (e.g., two samples before and after the first maximum value) to improve the detection accuracy.

The detection result at maximum value detection section 192 is then outputted to decision section 193.

Decision section 193 first decides whether or not the maximum auto-correlation value obtained from auto-correlation value calculation section 191 is equal to or higher than threshold $\epsilon$. That is, decision section 193 decides whether or not the periodicity level of the excitation signal in the (n−1)-th frame is equal to or higher than the threshold.

When the maximum auto-correlation value is equal to or higher than threshold $\epsilon$, decision section 193 decides that the (n−1)-th frame does not include a non-periodic pulse waveform region and suspends subsequent processing. On the other hand, when the maximum auto-correlation value is less than threshold $\epsilon$, the (n−1)-th frame may include a non-periodic pulse waveform region, decision section 193 continues to perform subsequent processing.

When the maximum auto-correlation value is less than threshold $\epsilon$, decision section 193 further decides whether or not the difference between the first maximum value and second maximum value of the excitation amplitude (first maximum value−second maximum value) or ratio (first maximum value/second maximum value) is equal to or higher than threshold $\eta$. The amplitude of the excitation signal in the non-periodic pulse waveform region is assumed to have locally increased, decision section 193 detects that the region including the position of the first maximum value as non-periodic pulse waveform region $\Lambda$ when the difference or ratio is equal to or higher than threshold $\eta$ and outputs the region information to non-periodic pulse waveform suppression section 17. Here, regions symmetric with respect to the position of the first maximum value (approximately 0 to 3 samples on both sides of the position of the first maximum value are appropriate) are assumed to be non-periodic pulse waveform region $\Lambda$. Non-periodic pulse waveform region $\Lambda$ need not always be regions symmetric with respect to the position of the first maximum value, but may also be asymmetric regions including, for example, more samples following the first maximum value. Furthermore, a region centered on the first maximum value, where the excitation amplitude is continuously equal to or higher than the threshold may be considered as non-periodic pulse waveform region $\Lambda$, and non-periodic pulse waveform region $\Lambda$ may be made variable.

Figure 5:
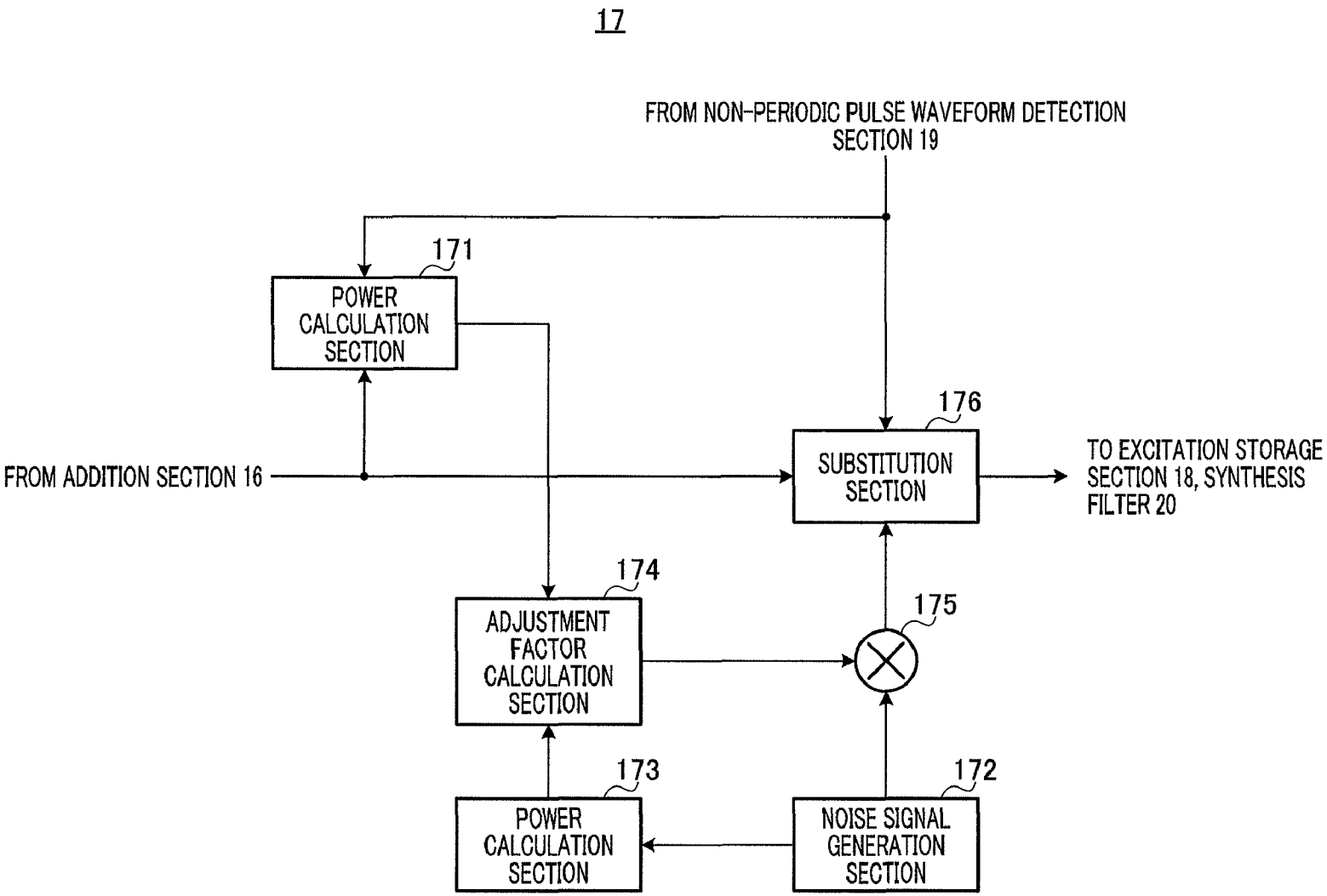
FIG. 5 is a block diagram showing the configuration of a non-periodic pulse waveform suppression section according to Embodiment 1.

Next, details of non-periodic pulse waveform suppression section 17 will be explained. FIG. 5 is a block diagram showing the configuration of non-periodic pulse waveform suppression section 17. Non-periodic pulse waveform suppression section 17 suppresses a non-periodic pulse waveform only in the non-periodic pulse waveform region in the (n−1)-th frame as follows.

In FIG. 5, power calculation section 171 calculates average power Pavg per sample of the excitation signal in the (n−1)-th frame according to equation 6 and outputs average power Pavg to adjustment factor calculation section 174. At this time, power calculation section 171 calculates the average power by excluding the excitation signal in the non-periodic pulse waveform region in the (n−1)-th frame according to the region information from non-periodic pulse waveform detection section 19. In equation 6, excavg[ ] corresponds to exc[ ] when all amplitudes in the non-periodic pulse waveform region are 0.

(Equation 6)

$$Pavg = \sqrt{\sum_{i=0}^{T0-1} excavg[PITMAX-1-i] * excavg[PITMAX-1-i]/(T0-\Lambda)} \quad [6]$$

Noise signal generation section 172 generates a random noise signal and outputs the random noise signal to power calculation section 173 and multiplication section 175. It is not preferable that the generated random noise signal include peak waveforms, and therefore noise signal generation section 172 may limit the random range or may apply clipping processing or the like to the generated random noise signal.

Power calculation section 173 calculates average power Ravg per sample of the random noise signal according to equation 7 and outputs average power Ravg to adjustment factor calculation section 174. rand in equation 7 is a random noise signal sequence, which is updated in frame units (or in sub-frame units).

(Equation 7)

$$Ravg = \sqrt{\sum_{i=0}^{\Lambda-1} rand[i] * rand[i]/\Lambda} \quad [7]$$

Adjustment factor calculation section 174 calculates factor (amplitude adjustment factor) $\beta$ to adjust the amplitude of the random noise signal according to equation 8 and outputs the adjustment factor to multiplication section 175.

[8]

$$\beta = Pavg/Ravg \quad \text{(Equation 8)}$$

As shown in equation 9, multiplication section 175 multiplies the random noise signal by amplitude adjustment factor $\beta$. This multiplication adjusts the amplitude of the random noise signal to be equivalent to the amplitude of the excitation signal outside the non-periodic pulse waveform region in the (n−1)-th frame. Multiplication section 175 outputs random noise signal after the amplitude adjustment to substitution section 176.

[9]

$$aftrand[k]=\beta*rand[k] \quad 0\leqq k<\Lambda \qquad \text{(Equation 9)}$$

Figure 6:
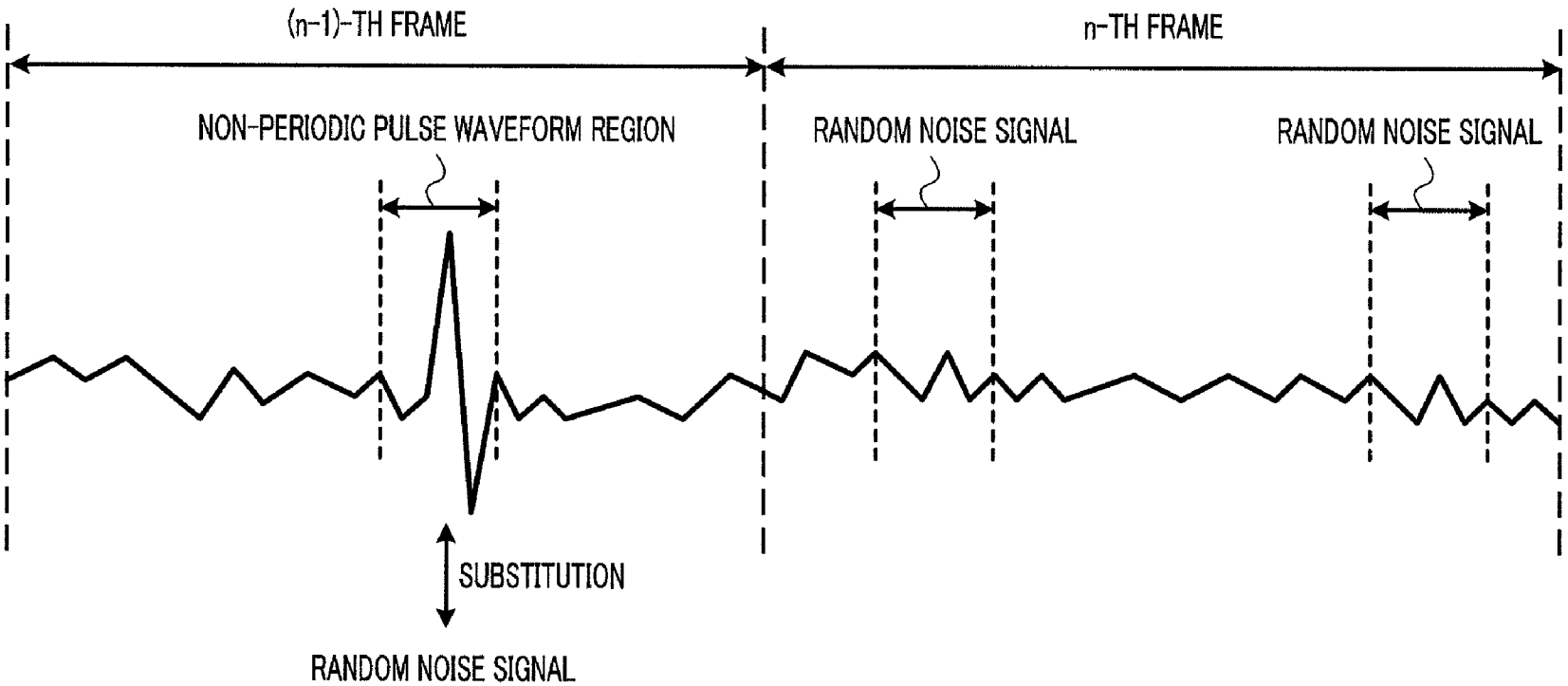
FIG. 6 illustrates the operation of a speech decoding apparatus according to Embodiment 1.
Figure 7:
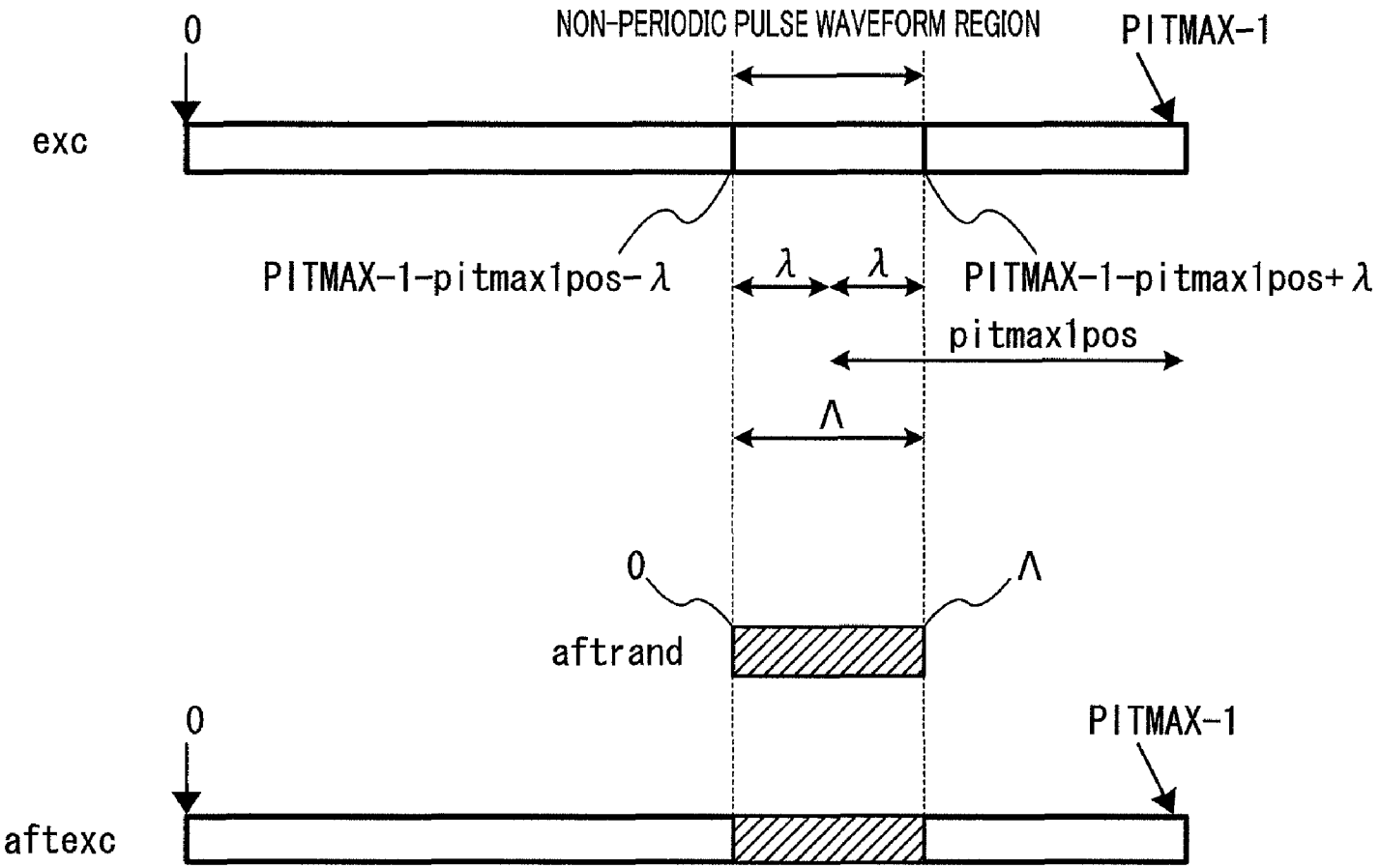
FIG. 7 illustrates the operation of a substitution section according to Embodiment 1.

As shown in FIG. 6, substitution section 176 substitutes the random noise signal after the amplitude adjustment for only the excitation signal in the non-periodic pulse waveform region out of the excitation signal in the (n−1)-th frame according to the region information from non-periodic pulse waveform detection section 19 and outputs the random noise signal. Substitution section 176 outputs the excitation signal outside the non-periodic pulse waveform region in the (n−1)-th frame as they are. The operation of this substitution section 176 is expressed by an equation like equation 10. In equation 10, aftexc is the excitation signal outputted from substitution section 176. Furthermore, FIG. 7 shows the operation of substitution section 176 expressed by equation 10.

(Equation 10)

$$\begin{aligned} aftexc[i] &= exc[i] && 0 \leq i < PITMAX - 1 - pitmax1pos - \lambda \\ aftexc[i] &= aftrand[j] && \begin{cases} PITMAX - 1 - pitmax1pos - \lambda \leq i \leq \\ PITMAX - 1 - pitmax1pos + \lambda (0 \leq j < \Lambda) \end{cases} \\ aftexc[i] &= exc[i] && PITMAX - 1 - pitmax1pos + \lambda < i < PITMAX \end{aligned} \qquad [10]$$

In this way, the present embodiment substitutes the random noise signal after amplitude adjustment for only the excitation signal in the non-periodic pulse waveform region in the (n−1)-th frame, so that it is possible to suppress only the non-periodic pulse waveform while substantially maintaining the characteristic of the excitation signal in the (n−1)-th frame. Therefore, when performing frame loss concealment of the n-th frame using the (n−1)-th frame, the present embodiment can maintain continuity of power of decoded speech between the (n−1)-th frame and n-th frame while preventing generation of decoded speech that brings perceptually strong uncomfortable feeling, such as beep sound caused by repeated use of non-periodic pulse waveforms for frame loss concealment and obtain decoded speech with less sound quality variation or sound skipping. Furthermore, the present embodiment does not substitute random noise signals for the entire (n−1)-th frame but substitutes a random noise signal for only the excitation signal in the non-periodic pulse waveform region in the (n−1)-th frame. Therefore, when performing frame loss concealment for the n-th frame using the (n−1)-th frame, the present embodiment can obtain perceptually natural decoded speech with no noticeable noise.

The non-periodic pulse waveform region may also be detected using decoded speech in the (n−1)-th frame instead of the excitation signal in the (n−1)-th frame.

Furthermore, it is also possible to decrease thresholds $\epsilon$ and $\eta$ in accordance with an increase in the number of consecutively lost frames so that non-periodic pulse waveforms can be detected more easily. Furthermore, it is also possible to increase the length of the non-periodic pulse waveform region in accordance with an increase in the number of consecutively lost frames so that the excitation signal is more whitened when the data loss time becomes longer.

Furthermore, as the signal used for substitution, it is also possible to use colored noise such as a signal generated so as to have a frequency characteristic outside the non-periodic pulse waveform region in the (n−1)-th frame, an excitation signal in a stationary region in the unvoiced region in the (n−1)-th frame or Gaussian noise or the like in addition to the random noise signal.

Although a configuration has been described where the non-periodic pulse waveform in the (n−1)-th frame is substituted by a random noise signal and the excitation signal in the (n−1)-th frame is repeatedly used in a pitch period when the lost n-th frame is decoded, it is also possible to adopt a configuration where an excitation signal is randomly extracted from other than the non-periodic pulse waveform region.

Furthermore, it is also possible to calculate an upper limit threshold of the amplitude from the average amplitude or smoothed signal power and substitute a random noise signal for an excitation signal which exists in or around a region exceeding the upper limit threshold.

Furthermore, the speech coding apparatus may detect a non-periodic pulse waveform region and transmit region information thereof to the speech decoding apparatus. By so doing, the speech decoding apparatus can obtain a more accurate non-periodic pulse waveform region and further improve the performance of frame loss concealment.

Embodiment 2

A speech decoding apparatus according to the present embodiment applies processing of randomizing phases of an excitation signal outside a non-periodic pulse waveform region in an (n−1)-th frame (phase randomization).

The speech decoding apparatus according to the present embodiment differs from Embodiment 1 only in the operation of non-periodic pulse waveform suppression section 17, and therefore only the difference will be explained below.

Non-periodic pulse waveform suppression section 17 first converts an excitation signal outside the non-periodic pulse waveform region in the (n−1)-th frame to a frequency domain.

Here, an excitation signal in the non-periodic pulse waveform region are excluded for the following reason. That is, the non-periodic pulse waveform exhibits a frequency characteristic weighted toward high frequencies such as plosive consonants, and the frequency characteristic thereof is considered to be different from the frequency characteristic outside the non-periodic pulse waveform region, and therefore perceptually more natural decoded speech can be obtained by performing frame loss concealment using an excitation signal outside the non-periodic pulse waveform region.

Next, in order to prevent non-periodic pulse waveforms from being used repeatedly for frame loss concealment, non-periodic pulse waveform suppression section 17 performs phase-randomization on the excitation signal transformed into a frequency domain signals.

Next, non-periodic pulse waveform suppression section 17 performs inverse transformation of the phase-randomized excitation signal into a time domain signal.

Non-periodic pulse waveform suppression section 17 then adjusts the amplitude of the inverse-transformed excitation signal to be equivalent to the amplitude of an excitation signal outside the non-periodic pulse waveform region in the (n−1)-th frame.

The excitation signal in the (n−1)-th frame obtained in this way is a signal where only the non-periodic pulse waveform is suppressed and the characteristic of the excitation signal in the (n−1)-th frame is substantially maintained as in the case of Embodiment 1. Therefore, according to the present embodiment as in the case of Embodiment 1, when frame loss concealment is performed on the n-th frame using the (n−1)-th frame, it is possible to maintain continuity of power of decoded speech between the (n−1)-th frame and n-th frame while preventing generation of decoded speech that brings perceptually strong annoying effect, such as beep sound caused by repeated use of non-periodic pulse waveforms for frame loss concealment, and to obtain decoded speech with less unstable sound quality or broken stream of sound.

When frame loss concealment is performed on the n-th frame using the (n−1)-th frame, the present embodiment can also obtain perceptually natural decoded speech with no noticeable noise.

It is also possible to reflect the frequency characteristic of the excitation signal in the (n−1)-th frame to the n-th frame using a method of randomizing only the amplitude while maintaining the polarity of the excitation signal in the (n−1)-th frame.

The embodiments of the present invention have been explained so far.

As the method for suppressing non-periodic pulse waveforms, a method for suppressing an excitation signal in a non-periodic pulse waveform region more strongly than an excitation signal in other regions may also be used.

Furthermore, when the present invention is applied to a network for which a packet comprised of one frame or a plurality of frames is used as a transmission unit (e.g., IP network), the "frame" in the above-described embodiments may be read as "packet."

Furthermore, although a case has been described as an example with the above embodiments where loss of the n-th frame is concealed using the (n−1)-th frame, the present invention can be implemented in the same way for all speech decoding that conceals loss of the n-th frame using a frame received before the n-th frame.

Furthermore, it is possible to provide a radio communication mobile station apparatus, radio communication base station apparatus and mobile communication system having the same operations and effects as those described above by mounting the speech decoding apparatus according to the above-described embodiments on a radio communication apparatus such as a radio communication mobile station apparatus and radio communication base station apparatus used in a mobile communication system.

Furthermore, the case where the present invention is implemented by hardware has been explained as an example, but the present invention can also be implemented by software. For example, the functions similar to those of the speech decoding apparatus according to the present invention can be realized by describing an algorithm of the speech decoding method according to the present invention in a programming language, storing this program in a memory and causing an information processing section to execute the program.

Furthermore, each function block used to explain the above-described embodiments may be typically implemented as an LSI constituted by an integrated circuit. These may be individual chips or may partially or totally contained on a single chip.

Furthermore, here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application of biotechnology is also possible.

The present application is based on Japanese Patent Application No. 2005-375401, filed on Dec. 27, 2005, the entire content of the specification, drawings and abstract is expressly incorporated by reference herein.

INDUSTRIAL APPLICABILITY

The speech decoding apparatus and the speech decoding method according to the present invention are applicable to a radio communication mobile station apparatus and a radio communication base station apparatus or the like in a mobile communication system.

The invention claimed is:

1. A speech decoding apparatus, comprising:

a detector that detects a non-periodic pulse waveform region in a first frame;

a suppressor that suppresses a non-periodic pulse waveform in the non-periodic pulse waveform region of the first frame;

a storage that stores information from the first frame;

a determiner that determines that a second frame after the first frame was lost during transmission;

a retriever that retrieves the stored information from the first frame; and a synthesizer that performs synthesis by a synthesis filter using the stored information from the first frame where the non-periodic pulse waveform is suppressed as an excitation and obtains decoded speech of the second frame after the first frame.

2. The speech decoding apparatus according to claim 1, wherein, when a maximum auto-correlation value of an excitation signal in the first frame is less than a threshold and a difference or ratio between a first maximum value and a second maximum value of excitation amplitude is equal to or higher than a threshold, the detector detects a region where the first maximum value exists as the non-periodic pulse waveform region.

3. The speech decoding apparatus according to claim 1, wherein the suppressor suppresses the non-periodic pulse waveform in the first frame by substituting a noise signal for the non-periodic pulse waveform.

4. The speech decoding apparatus according to claim 1, wherein the suppressor suppresses the non-periodic pulse waveform in the first frame by randomizing phases of an excitation signal outside the non-periodic pulse waveform region.

5. A speech decoding method, comprising:

detecting a non-periodic pulse waveform region in a first frame;

suppressing a non-periodic pulse waveform in the non-periodic pulse waveform region of the first frame;

storing information from the first frame;

determining that a second frame after the first frame was lost during transmission;

retrieving the stored information from the first frame; and performing synthesis by a synthesis filter using the stored information from the first frame where the non-periodic pulse waveform is suppressed as an excitation, and obtaining decoded speech of the second frame after the first frame.

* * * * *